US005947380A

United States Patent [19]

Coldren et al.

[11] Patent Number: 5,947,380

[45] Date of Patent: Sep. 7, 1999

[54] FUEL INJECTOR UTILIZING FLAT-SEAT POPPET VALVES

[75] Inventors: Dana R. Coldren, Fairbury; Marvin P. Schneider, East Peoria; James J. Streicher, Pontiac; David E. Martin, Normal, all of Ill.

[73] Assignees: Caterpillar Inc., Peoria, Ill.; Lucas Industries PLC, Solihull, United Kingdom

[21] Appl. No.: 08/962,809

[22] Filed: Nov. 3, 1997

[51] Int. Cl.[6] ..... F02M 47/02

[52] U.S. Cl. ..... 239/88; 239/124; 239/533.8; 251/129.1

[58] Field of Search ..... 239/88, 90, 93, 239/24–127, 533.8, 533.9, 579, 124; 251/129.05, 129.1, 129.21, 129.16

[56] References Cited

U.S. PATENT DOCUMENTS

| | | | |
|---|---|---|---|
| 4,628,881 | 12/1986 | Beck et al. | 123/447 |
| 5,054,691 | 10/1991 | Huang et al. | 239/585 |
| 5,119,792 | 6/1992 | Gu | 123/533 |
| 5,407,131 | 4/1995 | Maley et al. | 239/90 |
| 5,450,876 | 9/1995 | Reinicke | 137/614.9 |
| 5,474,234 | 12/1995 | Maley | 239/88 |
| 5,494,223 | 2/1996 | Hall et al. | 239/585.5 |
| 5,494,224 | 2/1996 | Hall et al. | 239/585.5 |
| 5,628,293 | 5/1997 | Gibson et al. | 123/446 |
| 5,673,853 | 10/1997 | Crofts et al. | 239/88 |
| 5,680,988 | 10/1997 | Patil et al. | 239/90 |
| 5,697,342 | 12/1997 | Anderson et al. | 123/446 |

FOREIGN PATENT DOCUMENTS

| | | |
|---|---|---|
| 2 114 658 | 8/1983 | United Kingdom . |
| 2 320 289 | 6/1998 | United Kingdom . |

OTHER PUBLICATIONS

U.K. Search Report dated Nov. 20, 1998, Appl. No. GB 9820407.6.

*Primary Examiner*—Kevin Weldon
*Attorney, Agent, or Firm*—William E. McCracken; Marshall, O'Toole, Gerstein, Murray & Borun

[57] ABSTRACT

A fuel injector includes a center tube, a first valve separate from the center tube and surrounding a first end of the center tube and a second valve also separate from the center tube and surrounding a second end thereof. A solenoid is actuable to independently move the first and second valves and thereby control the application of fluid pressures to first and second ends of a check assembly, in turn to control injection of fuel into an associated engine cylinder.

16 Claims, 4 Drawing Sheets

FUEL INJECTOR UTILIZING FLAT-SEAT POPPET VALVES

TECHNICAL FIELD

The present invention relates generally to fuel injection apparatus, and more particularly to a fuel injector utilizing flat-seat poppet valves.

BACKGROUND ART

Fuel injected engines employ fuel injectors, each of which delivers a metered quantity of fuel to an associated engine cylinder during each engine cycle. Prior fuel injectors were of the mechanically or hydraulically actuated type with either mechanical or hydraulic control of fuel delivery. More recently, electronically controlled fuel injectors have been developed. In the case of an electronic unit injector, fuel is supplied to the injector by a transfer pump. The injector includes a plunger which is movable by a cam-driven rocker arm to compress the fuel delivered by the transfer pump to a high pressure. An electrically operated mechanism either carried outside the injector body or disposed within the injector proper is then actuated to cause fuel delivery fuel to the associated engine cylinder.

In prior fuel injector designs, high pressure fuel is conducted through passages which are located outside of a central recess containing a solenoid which operates a valving mechanism. The passages are located close to the outer surface of the fuel injector and are formed by drilling intersecting holes. After drilling, portions of some of the holes must be filled with plugs. These passages and plugs are subjected to very high fluid pressures, thus requiring careful design, thus increasing complexity and cost.

In addition to the foregoing, because the high pressure passages are located outside of the solenoid, the size of the solenoid is necessarily limited, thereby limiting the available solenoid force.

Still further, a prior type of fuel injector utilizes a direct operated check valve, which includes upper and lower valve seats which must be precisely aligned for proper operation. Manufacturing and assembly tolerances must, therefore, be kept tight, further increasing cost.

SUMMARY OF THE INVENTION

A fuel injector includes a high pressure fuel passage which is substantially coincident with the center axis of the injector.

More particularly, in accordance with one aspect of the present invention, a fuel injector includes an injector case defining a central axis, a plunger cavity and a plunger passage in fluid communication with the plunger cavity and terminating at an opening disposed substantially coincident with the central axis. A center tube is provided having a first end adjacent the opening, a second end and a tube passage between the first and second ends. A first valve is disposed in a valve recess and surrounds the first end of the center tube and is movable between an open position wherein the tube passage is placed in fluid communication with the plunger passage and a closed position wherein the tube passage is in fluid communication the valve recess. A second valve surrounds the second end of the center tube and is movable between a first position wherein first and second check end passages are in fluid communication with one another and a second position wherein the first check end passage is isolated from the second check end passage. An actuator is further provided for moving the first and second valves.

Preferably, each of the first and second valves comprises a flat-seat poppet valve. Also preferably, the second valve places the second check end passage in fluid communication with the drain passage when the second valve is moved to the second position.

Still further in accordance with the preferred embodiment, the actuator comprises a solenoid which may include first and second armatures coupled to the first and second valves, respectively.

Preferably, the first valve is biased toward the open position by a first valve spring and the second valve is biased toward the first position by a second valve spring. The first valve spring may exert a first spring force and the second valve spring may exert a second spring force greater than the first spring force.

In accordance with an alternative aspect of the present invention, a fuel injector includes an injector case defining a central axis and a central passage substantially coincident with the central axis for conducting fuel between first and second ends of the central passage. A first flat-seat poppet valve surrounds the first end of the central passage and a second flat-seat poppet valve surrounds the second end of the central passage. An actuator is provided for moving the first and second flat-seat poppet valves.

In accordance with yet another aspect of the present invention, a fuel injector includes an injector case defining a central axis and a plunger passage substantially coincident with the central axis. A center tube includes a central passage substantially coincident with the central axis for conducting fuel between first and second ends of the center tube. A first flat-seat poppet valve is disposed in a valve recess and surrounding the first end of the center tube and is movable between open and closed positions wherein the valve recess is placed in fluid communication with the plunger passage and the central passage when the first flat-seat poppet valve is moved to the open position. The central passage is placed in fluid communication with the plunger passage and is isolated from the valve recess when the first flat-seat poppet valve is moved to the closed position. A first valve spring exerts a first spring force to bias the first flat-seat poppet valve to the open position and first and second check end passages are coupled to first and second ends of a check assembly. A second flat-seat poppet valve surrounds the second end of the center tube and is movable between first and second positions wherein the central passage is placed in fluid communication with the first and second check end passages when the second flat-seat poppet valve is moved to the first position. The central passage is placed in fluid communication with the first check end passage and the second check end passage is placed in fluid communication with a drain passage and is isolated from the central passage when the second flat-seat poppet valve is moved to the second position. A second valve spring exerts a second spring force to bias the second flat-seat poppet valve to the first position wherein the second spring force is greater than the first spring force. A solenoid is provided having a solenoid coil and first and second armatures are coupled to the first and second flat-seat poppet valves, respectively, wherein the solenoid coil is energizable by first and second current waveform portions to sequentially move the first and second flat-seat poppet valves.

The present invention eliminates high pressure intersecting holes and plugs and further eliminates valve seat alignment problems. Fewer parts and manufacturing operations are required and more space is provided for a larger diameter solenoid so that increased solenoid force can be obtained.

Further, more space can be made available for other components, such as an external wiring connector.

BEST MODE FOR CARRYING OUT THE INVENTION

Figure 1:
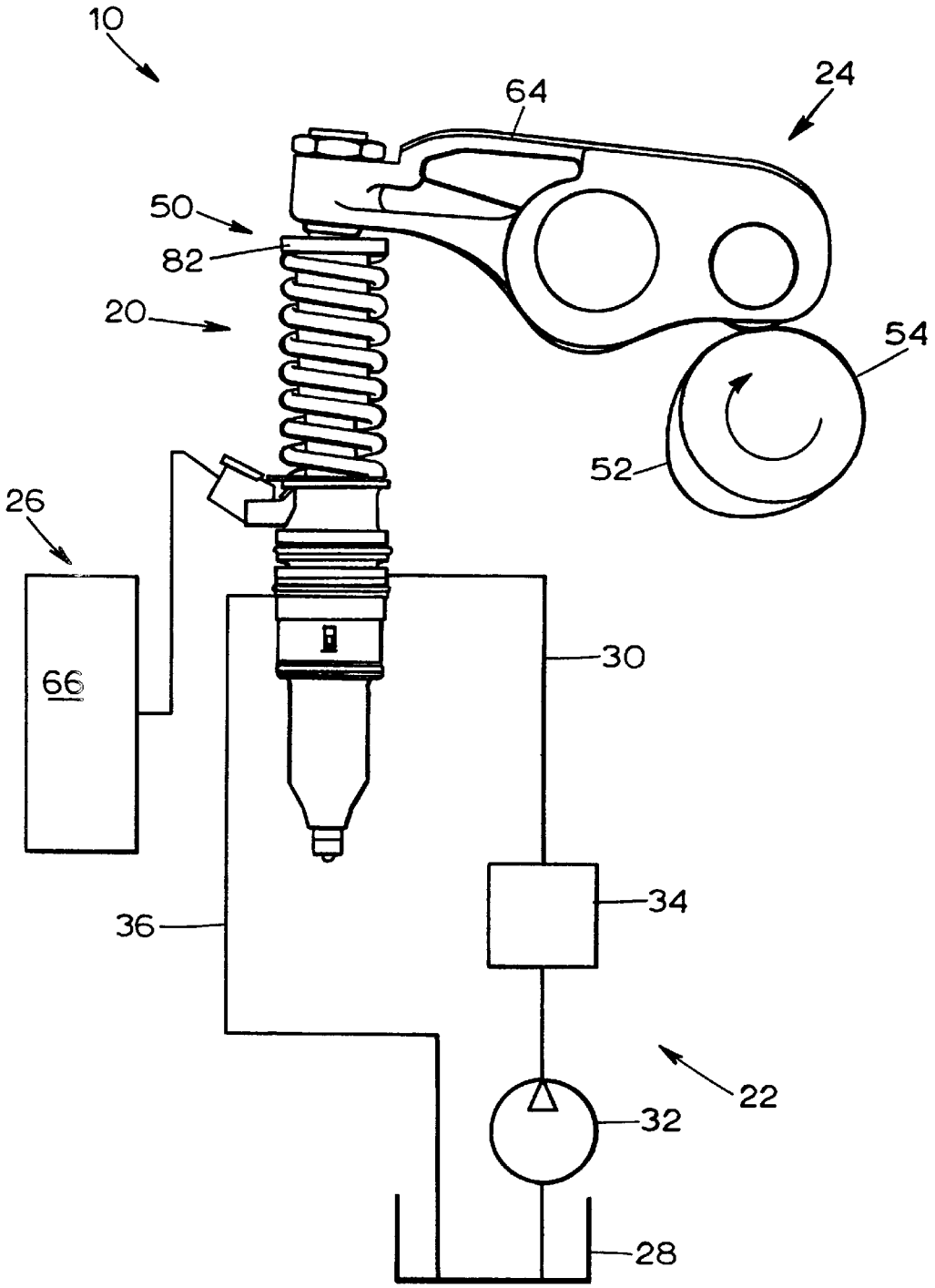
FIG. 1 is an elevational view of a fuel injector incorporating the present invention together with a cam shaft and rocker arm and further illustrating a block diagram of a transfer pump and a drive circuit for controlling the fuel injector.

Referring to FIG. 1, a portion of a fuel system 10 is shown adapted for a direct-injection diesel-cycle reciprocating internal combustion engine. However, it should be understood that the present invention is also applicable to other types of engines, such as rotary engines or modified-cycle engines, and that the engine may contain one or more engine combustion chambers or cylinders. The engine has at least one cylinder head wherein each cylinder head defines one or more separate injector bores, each of which receives an injector 20 according to the present invention.

The fuel system 10 further includes apparatus 22 for supplying fuel to each injector 20, apparatus 24 for causing each injector 20 to pressurize fuel and apparatus 26 for electronically controlling each injector 20.

The fuel supplying apparatus 22 preferably includes a fuel tank 28, a fuel supply passage 30 arranged in fluid communication between the fuel tank 28 and the injector 20, a relatively low pressure fuel transfer pump 32, one or more fuel filters 34 and a fuel drain passage 36 arranged in fluid communication between the injector 20 and the fuel tank 28. If desired, fuel passages may be disposed in the head of the engine in fluid communication with the fuel injector 20 and one or both of the passages 30 and 36.

The apparatus 24 may be any mechanically-actuating device or hydraulically-actuating device. In the embodiment shown a tappet and plunger assembly 50 associated with the injector 20 is mechanically actuated indirectly or directly by a cam lobe 52 of an engine-driven cam shaft 54. The cam lobe 52 drives a pivoting rocker arm assembly 64 which in turn reciprocates the tappet and plunger assembly 50. Alternatively, a push rod (not shown) may be positioned between the cam lobe 52 and the rocker arm assembly 64.

The electronic controlling apparatus 26 preferably includes an electronic control module (ECM) 66 which controls: (1) fuel injection timing; (2) total fuel injection quantity during an injection cycle; (3) fuel injection pressure; (4) the number of separate injection segments during each injection cycle; (5) the time interval(s) between the injection segments; and (6) the fuel quantity delivered during each injection segment of each injection cycle.

Preferably, each injector 20 is a unit injector which includes in a single housing apparatus for both pressurizing fuel to a high level (for example, 207 MPa (30,000 p.s.i.) and injecting the pressurized fuel into an associated cylinder. Although shown as a unitized injector 20, the injector could alternatively be of a modular construction wherein the fuel injection apparatus is separate from the fuel pressurization apparatus.

Figure 2:
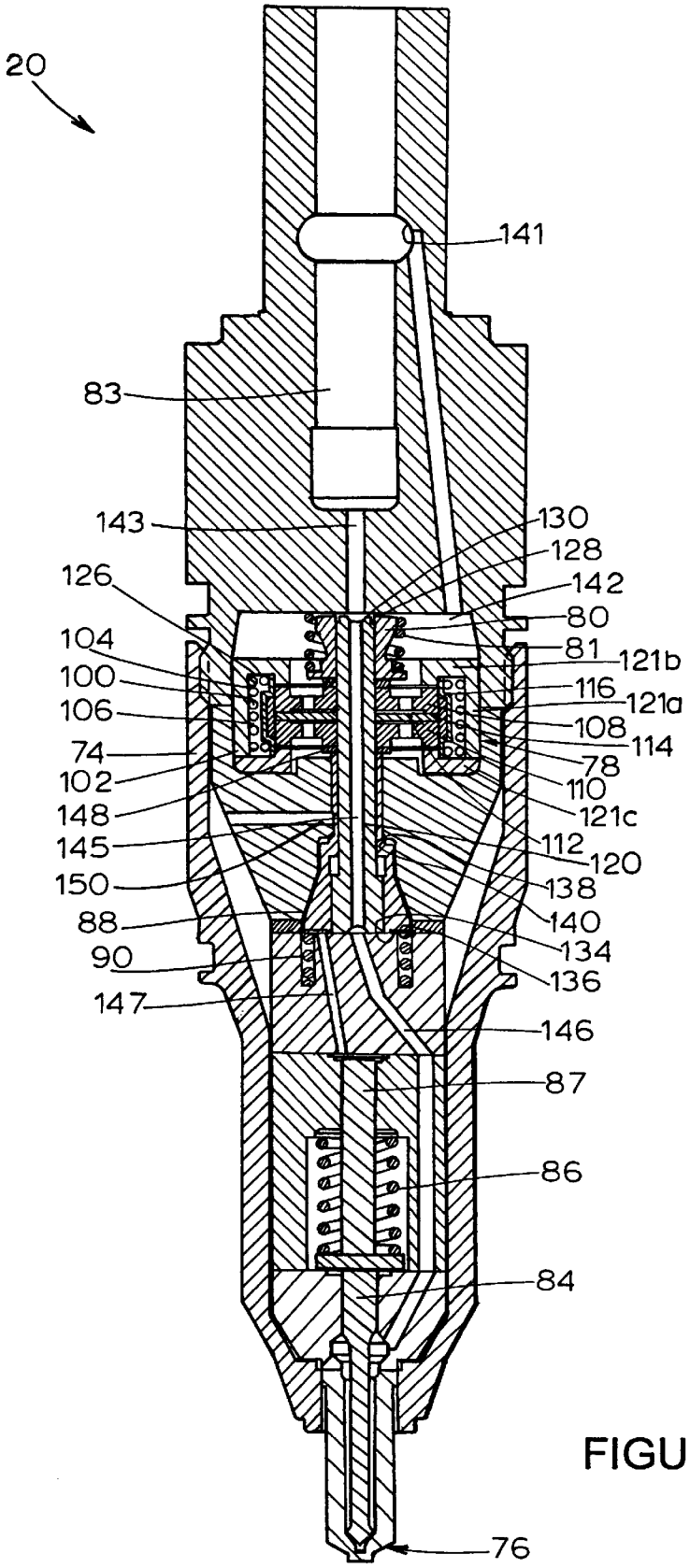
FIG. 2 is a fragmentary sectional view of the fuel injector of FIG. 1.
Figure 3:
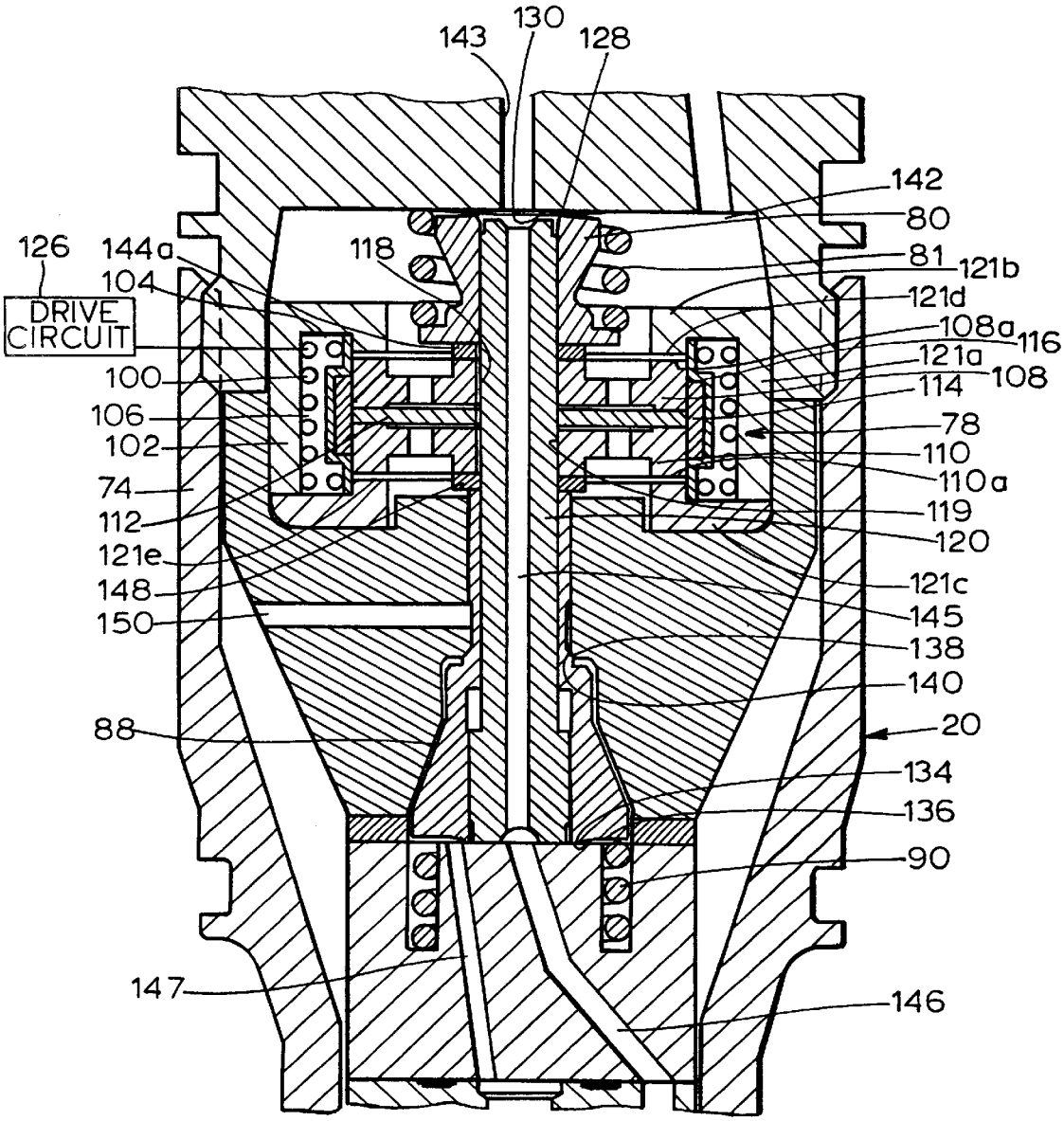
FIG. 3 is an enlarged, fragmentary sectional view of the fuel injector of FIG. 2 illustrating the solenoid, high pressure spill valve and DOC valve in greater detail.

Referring now to FIGS. 2 and 3, the injector 20 includes a case 74, a nozzle portion 76, an electrical actuator 78, a spill valve 80, a spill valve spring 81, a plunger 82 (seen only in FIG. 1) disposed in a plunger cavity 83, a check 34, a check spring 86 surrounding a check piston 87 wherein the check 84 and the check piston comprise a check assembly, a direct operated check (DOC) valve 88 and a DOC spring 90. In the preferred embodiment, the spill valve spring 81 exerts a first spring force when compressed whereas the DOC spring 90 exerts a second spring force greater than the first spring force when compressed.

The electrical actuator 78 comprises a solenoid 100 for controlling the valves 80, 88. The solenoid 100 includes a stator 102 having a recess 104 within which is disposed a solenoid coil 106. The solenoid 100 further includes an armature assembly comprising first and second annular armatures 108, 110, respectively, which are disposed on either side of an annular central spacer member 112 fabricated of nonmagnetic (i.e., high reluctance) material. The central spacer member 112 is planar and is disposed within and freely movable with respect to a cylindrical outboard flux conduction member 114. The flux conduction member 114 is fabricated of low reluctance material and is molded into a coil bobbin 116 retained within the stator 102. The first and second armatures 108, 110 include portions which are located within the axial extent of the flux conduction member 114 and further include coterminous cylindrical inner walls 118, 119 (FIG. 3) which surround a central tube 120, as do the first and second valves 80, 88 and the central spacer member 112.

When current is applied to the solenoid coil 106, magnetic flux is developed which flows through a center portion 121*a* and outer legs 121*b*, 121*c* of the solenoid stator 102, the flux conduction member 114 and the first and second armatures 108, 110. The spacer member 112 blocks the passage of magnetic flux between the armatures 108, 110. In response to such application of current, each armature 108, 110 is axially urged toward an opposing outer leg 121*b*, 121*c*, respectively, of the stator 102 and away from the spacer member 112.

If desired, the central spacer member 112 may alternatively be secured to the cylindrical outboard flux conduction member 114, in which case the outer leg 121*b* must be separate from the center portion 121*a* (like the outer leg 121*c*) to allow the various parts to be assembled before the outer legs 121*b*, 121*c* are secured to the center portion 121*a*.

Industrial Applicability

Figure 4:
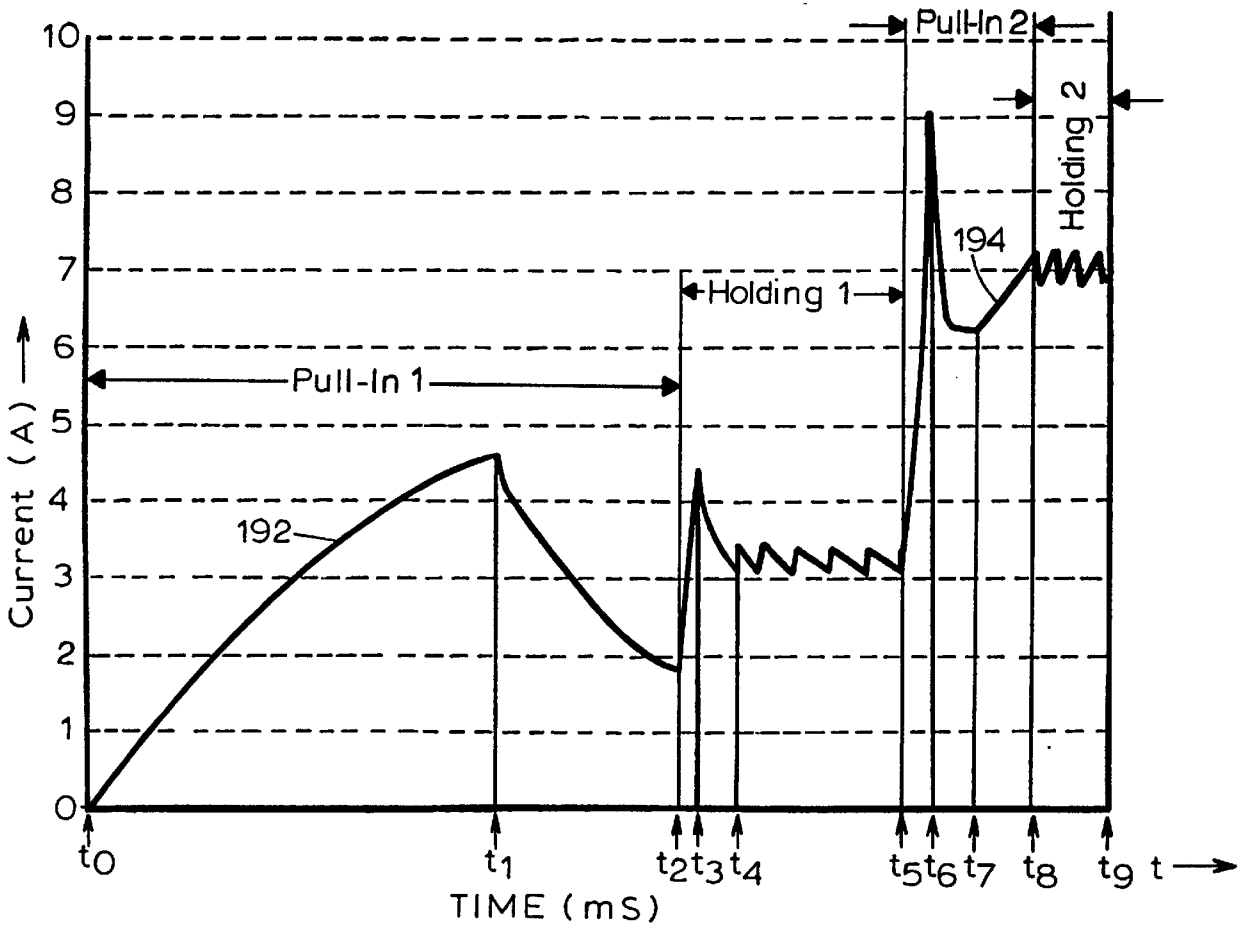
FIG. 4 is a waveform diagram illustrating current waveforms supplied to the solenoid coil of FIGS. 2 and 3.

FIG. 4 illustrates current waveform portions 122, 124 applied by a drive circuit 126 to the solenoid winding 106 during a portion of an injection sequence to accomplish fuel injection. The first current waveform portion 122 is applied between times $t=t_0$ and $t=t_5$ and the second current waveform portion 124 is applied subsequent to the time $t=t_5$. Between time $t=t_0$ and time $t=t_2$ a first pull-in current is provided to the solenoid winding 106 and a first holding current at somewhat reduced levels is thereafter applied between times $t=t_2$ and $t=t_5$. A second pull-in current generally of greater magnitude than the first pull-in current level is applied between times $t=t_5$and $t=t_8$, and a second holding current generally greater in magnitude than the first holding current level is applied between times $t=t_8$ and $t=t_9$.

More specifically, at the beginning of an injection sequence, the solenoid coil 106 is unenergized, thereby permitting the spill valve spring 81 (which exerts a first spring force) to open the spill valve 80 such that a sealing surface 128 is spaced from a valve seat 130. Also at this time, the DOC valve spring 90 (which exerts a second spring force greater than the first spring force) biases the DOC valve 88 upwardly to a position whereby a sealing surface 134 is spaced from a valve seat 136 and such that a further sealing surface 138 is in sealing contact with a further valve seat 140. Under these conditions, fuel enters a valve recess 142 and thereafter flows through a plunger passage 143, passages (not shown) in the plunger 82 and an annular groove 141 surrounding the plunger 82 to drain. Subsequently, the lobe on the cam pushes down on the plunger 82 of the injector 20, taking the passages in the plunger 82 out of fluid communication with the annular groove 141, so that fuel pressurization can then take place. The current waveform portion 122 is then delivered to the solenoid coil 106 by the drive circuit 126. The pull-in and holding current levels of the portion 122 and the valve springs 81, 90 are selected such that the motive force developed by the first armature 108 exceeds the first spring force developed by the spring 81 but the motive force developed by the second armature 110 is less than the second spring force developed by the spring 90. Consequently the first armature 108 moves upwardly against a spacer 144*a* and closes the spill valve 80. At this point, the sealing surface 128 is moved into sealing contact with the seat 130, thereby isolating the plunger passage 143 from the valve recess 142. Also during this time, because the valve spring 90 exerts a greater spring force than the force developed by the second armature 110, the DOC valve 88 remains open in the previously described condition. Fluid pressurized by downward movement of the plunger 82 is thereby delivered through the plunger passage 143 and a central passage 145 in the central tube 120 to first and second check end passages 146, 147 leading to bottom and top ends, respectively, of the check assembly. Because the fluid pressures on the ends of the check assembly are substantially balanced, the check remains closed at this time. Because the check 84 is closed, there is a smaller area exposed to the fuel pressure on the lower end of the check 84 than the area exposed to the fuel pressure at the upper end of the check assembly, and hence there is a net downward force which augments the spring force exerted by the check spring 86 to keep the check 84 closed.

The drive circuit 126 thereafter delivers the second current waveform portion 124 to the solenoid coil 106. This increased current level develops an increased force on the second armature 110 which exceeds the second spring force, causing such armature to move downwardly. This downward movement is transmitted by a spacer 148 to the valve 88 to cause the valve 88 also to move downwardly such that the sealing surface 134 is moved into sealing contact with the valve seat 136. In addition, the sealing surface 138 moves out of sealing contact with the further valve seat 140. The effect of this movement is to isolate the second check end passage 147 from the high pressure fluid in the central passage 145 and to permit fluid communication between the second check end passage 147 and a passage 150 in fluid communication with drain (the connection between the passage 150 and drain is not shown in the Figs.). The pressures across the check assembly then become unbalanced, thereby overcoming the check spring preload driving the check upwardly so that fuel is injected into an associated cylinder.

When injection is to be terminated, the current delivered to the solenoid coil 106 may be reduced to the holding level of the first current waveform portion 122 as illustrated in FIG. 4. If desired, the current delivered to the solenoid coil 106 may be reduced to zero or any other level less than the first holding level. In any case, the DOC valve 88 first moves upwardly, thereby reconnecting the second check end passage 147 to the passage 146. The fluid pressures across the check assembly thus become substantially balanced, allowing the check spring 86 and the fluid forces acting on the check assembly to close the check 84. The current may then be reduced to zero or any other level less than the first holding level, (if it has not been already so reduced). Regardless of whether the applied current is immediately dropped to the first holding level or to a level less than the first holding level, the spill valve spring 81 opens the spill valve 80 after the DOC spring 90 moves the DOC valve 88 upwardly.

If desired, the solenoid coil may receive more than two current waveform portions to cause either a single armature or multiple armatures to move to any number of positions (not just two), and thereby operate one or more valves or other movable elements.

Still further, multiple or split injections per injection cycle can be accomplished by supplying suitable waveform portions to the solenoid coil 106. For example, the first and second waveform portions 122, 124 may be supplied to the coil 106 to accomplish a pilot or first injection. Immediately thereafter, the current may be reduced to the first holding current level and then increased again to the second pull-in and second holding levels to accomplish a second or main injection. Alternatively, the pilot and main injections may be accomplished by initially applying the waveform portions 122 and 124 to the solenoid coil 106 and then repeating application of the portions 122 and 124 to the coil 106. The durations of the pilot and main injections (and, hence, the quantity of fuel delivered during each injection) are determined by the durations of the second holding levels in the waveform portions 124. Of course, the waveform shapes shown in FIG. 4 may be otherwise varied as necessary or desirable to obtain a suitable injection response or other characteristic.

As should be evident from the foregoing, the central passage 145 is substantially coincident with the central axis of the fuel injector 20 and is aligned at first and second ends with the ends of the plunger passage 143 and the first check end passage 146, respectively. Because fuel is directed along the center of the injector, high pressure intersecting holes and plugs are not required. Further, there is no need to align the lower valve seat of the DOC valve 88. The valve can be made with fewer parts and the number of steps required to manufacture the valve is reduced. Still further, the solenoid 100 can have a larger diameter, thereby allowing the solenoid 100 to develop high armature forces, in turn improving injector operation. Because the fuel passages do not pass around the outside of the solenoid, more space is available for other components, such as a wiring connector for connecting the solenoid to the drive circuit 126.

While the fuel injector of the present invention utilizes flat-seats which may require higher sealing forces than tapered or conical seat valves, and while the mass of the DOC valve may be greater than valves of previous designs, causing a slightly slower response, it is felt that these potential disadvantages can be outweighed by the advantages noted above.

If desired, the solenoid 100 may be replaced by any other suitable actuator.

Numerous modifications and alternative embodiments of the present invention will be apparent to those skilled in the art in view of the foregoing description. Accordingly, this description is to be construed as illustrative only and is for the purpose teaching those skilled in the art the best mode of carrying out the invention. The details of the structure and/or function may be varied substantially without departing from the spirit of the invention, and the exclusive use of all modifications which come within the scope of the appended claims is reserved.

We claim:

1. A fuel injector, comprising:

an injector case defining a central axis;

a plunger cavity;

a plunger passage in fluid communication with the plunger cavity and terminating at an opening disposed substantially coincident with the central axis;

a center tube having a first end adjacent the opening, a second end and a tube passage between the first and second ends;

a first valve disposed in a valve recess and surrounding the first end of the center tube and movable between a closed position wherein the tube passage is placed in fluid communication with the plunger passage and an open position wherein the tube passage is in fluid communication with the valve recess;

first and second check end passages;

a second valve separate from and surrounding the second end of the center tube and movable between a first position wherein the first and second check end passages are in fluid communication with one another and a second position wherein the first check end passage is isolated from the second check end passage; and an actuator for moving the first and second valves.

2. The fuel injector of claim 1, wherein each of the first and second valves comprises a flat-seat poppet valve.

3. The fuel injector of claim 1, wherein the second valve places the second check end passage in fluid communication with a drain passage when the second valve is moved to the second position.

4. The fuel injector of claim 1, wherein the actuator comprises a solenoid.

5. The fuel injector of claim 4, wherein the solenoid includes first and second armatures coupled to the first and second valves, respectively.

6. The fuel injector of claim 1, wherein the first valve is biased toward the open position by a first valve spring and the second valve is biased toward the first position by a second valve spring.

7. The fuel injector of claim 1, wherein the first valve spring exerts a first spring force and the second valve spring exerts a second spring force greater than the first spring force.

8. A fuel injector, comprising:

an injector case defining a central axis;

a center tube including a central passage substantially coincident with the central axis over substantially a full length of the central passage for conducting fuel between first and second ends of the central passage;

a first flat-seat poppet valve separate from the center tube and surrounding the first end of the central passage;

a second flat-seat poppet valve separate from the center tube and surrounding the second end of the central passage; and an actuator for moving the first and second flat-seat poppet valves.

9. The fuel injector of claim 8, wherein each of the first and second flat-seat poppet valves is movable between two positions.

10. The fuel injector of claim 9, wherein the first flat-seat poppet valve is disposed in a valve recess and is movable to an open position to place the central passage in fluid communication with the valve recess and is movable to a closed position to place the central passage in fluid communication with a plunger passage.

11. The fuel injector of claim 10, wherein the second flat-seat poppet valve is movable to a first position to place the central passage in fluid communication with first and second check end passages and is movable to a second position to isolate the first check end passage from the second check end passage and to place the second check end passage in fluid communication with a drain passage.

12. The fuel injector of claim 8, wherein the actuator comprises a solenoid.

13. The fuel injector of claim 12, wherein the solenoid includes first and second armatures coupled to the first and second valves, respectively.

14. The fuel injector of claim 13, wherein the first flat-seat poppet valve is biased toward an open position by a first valve spring and the second flat-seat poppet valve is biased toward a certain position by a second valve spring.

15. The fuel injector of claim 14, wherein the first valve spring exerts a first spring force and the second valve spring exerts a second spring force greater than the first spring force.

16. A fuel injector, comprising:

an injector case defining a central axis;

a plunger passage substantially coincident with the central axis;

a center tube having a central passage substantially coincident with the central axis for conducting fuel between first and second ends of the center tube;

a first flat-seat poppet valve disposed in a valve recess and surrounding the first end of the center tube and movable between open and closed positions wherein the valve recess is placed in fluid communication with the plunger passage and the central passage when the first flat-seat poppet valve is moved to the open position and wherein the central passage is placed in fluid communication with the plunger passage and isolated from the valve recess when the first flat-seat poppet valve is moved to the closed position;

a first valve spring exerting a first spring force to bias the first flat-seat poppet valve to the open position;

a check;

first and second check end passages coupled to first and second ends, respectively, of the check;

a drain passage;

a second flat-seat poppet valve separate from the center tube and surrounding the second end of the center tube and movable between first and second positions wherein the central passage is placed in fluid communication with the first and second check end passages when the second flat-seat poppet valve is moved to the first position and wherein the central passage is placed in fluid communication with the first check end passage and the second check end passage is placed in fluid communication with the drain passage and is isolated from the central passage when the second flat-seat poppet valve is moved to the second position;

a second valve spring exerting a second spring force to bias the second flat-seat poppet valve to the first position wherein the second spring force is greater than the first spring force; and a solenoid having a solenoid coil and first and second armatures coupled to the first and second flat-seat poppet valves, respectively, wherein the solenoid coil is energizable by first and second current waveform portions to sequentially move the first and second flat-seat poppet valves.

* * * * *